US006676249B2

(12) United States Patent
Lebens

(10) Patent No.: US 6,676,249 B2
(45) **Date of Patent: *Jan. 13, 2004**

(54) CONTINUOUS COLOR INK JET PRINT HEAD APPARATUS AND METHOD

(75) Inventor: John A. Lebens, Rush, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/466,977

(22) Filed: Dec. 17, 1999

(65) Prior Publication Data

US 2002/0001022 A1 Jan. 3, 2002

(51) Int. Cl.[7] ..... B41J 2/02
(52) U.S. Cl. ..... 347/75
(58) Field of Search ..... 347/75, 43, 48, 347/74, 85, 87, 20, 15

(56) References Cited

U.S. PATENT DOCUMENTS

| | | | | | |
|---|---|---|---|---|---|
| 3,946,398 | A | | 3/1976 | Kyser et al. | 347/75 |
| 4,614,953 | A | * | 9/1986 | Lapeyre | 347/75 |
| 4,882,595 | A | | 11/1989 | Trueba et al. | 347/75 |
| 5,113,198 | A | * | 5/1992 | Nishikawa et al. | 347/21 |
| 5,371,529 | A | * | 12/1994 | Eguchi et al. | 347/7 |
| 5,444,472 | A | * | 8/1995 | Due et al. | 347/85 |
| 5,606,351 | A | | 2/1997 | Hawkins | 347/15 |
| 5,625,397 | A | | 4/1997 | Allred et al. | 347/100 |
| 5,764,258 | A | * | 6/1998 | Hetzer et al. | 347/85 |
| 5,880,752 | A | * | 3/1999 | Weber et al. | 347/15 |
| 6,099,113 | A | * | 8/2000 | Blouin et al. | 347/85 |
| 6,302,519 | B1 | * | 10/2001 | Fukuda et al. | 347/43 |
| 6,474,795 | B1 | * | 11/2002 | Lebens et al. | 347/82 |

* cited by examiner

*Primary Examiner*—Michael Nghiem
(74) *Attorney, Agent, or Firm*—Walter S. Stevens

(57) ABSTRACT

A continuous color ink jet print head (40) for an electronic printing device is composed of a nozzle (42), pressurized ink sources (46, 48), and a print head surface (50) having channels (61, 62, 64, 66) disposed therein such that each channel (61, 62, 64, 66) is in communication with the nozzle (42). The continuous color ink jet print head (40) also includes a microvalve (52, 56) disposed within each of the channels (61, 62, 64, 66) such that each channel (61, 62, 64, 66) is connected through the microvalve (52, 56) to a pressurized ink source (46, 48), thereby permitting ink from the pressurized ink source (46, 48) to flow through the channel (61, 62, 64, 66) and thereafter be ejected from the nozzle (42) when the pressurized ink source (46, 48) has attained a particular threshold pressure. The microvalve (52, 56) itself is a thermally activated microvalve (52, 56) that permits colored patterns of dots of varying intensities to be ejected from the nozzle (42) onto a receiver at a constant rate, thereby maintaining a static ink printed pixel size. By selectively controlling the length of time the microvalve (52, 56) is actuated, a range of colored inks is permitted to be ejected from the nozzle (42) onto the receiver.

35 Claims, 10 Drawing Sheets

CONTINUOUS COLOR INK JET PRINT HEAD APPARATUS AND METHOD

FIELD OF THE INVENTION

This present invention relates to ink jet printer apparatus and methods. In particular, the present invention relates to color printing apparatus and methods. More particularly, the present invention relates to continuous ink jet print heads, wherein controlled and variable saturation color printing results from the in-flight mixing of ink containing fluids with a carrier fluid.

BACKGROUND OF THE INVENTION

Modern color printing relies heavily on ink jet printing techniques. The term "ink jet" as utilized herein is intended to include all drop-on-demand or continuous ink jet propulsion systems including, but not limited to, thermal ink jet, piezoelectric, and continuous, which are well known in the printing arts. An ink jet printer produces images on a receiver by ejecting ink droplets onto a receiver medium, such as paper, in an image-wise fashion. The advantages of non-impact, low-noise, low-energy use, and low cost operations, in addition to the capability of the printer to print on plain paper, are largely responsible for the wide acceptance of ink jet printers in the marketplace.

Two types of drop-on-demand ink jet printers dominate the market today. Drop-on-demand "thermal" ink jet printers, operate by rapidly heating a small volume of ink, which causes the ink to vaporize and expand, thereby ejecting the ink through an orifice or nozzle. The ejected ink thereafter lands on selected areas of a receiving medium. The sequenced operation of an array of such orifices or nozzles moving past a receiver writes a dot pattern of ink on the receiver, forming text or pictorial images. The print head typically includes an ink reservoir and channels that replenish the ink to the region in which vaporization occurs. An example of an arrangement of thermal ink jet heaters, ink channels, and nozzles is disclosed in U.S. Pat. No. 4,882,595 to Truebe et al., entitled "Hydraulically Tuned Channel Architecture."

Drop-on-demand piezoelectric printers, on the other hand, operate utilizing a separate piezoelectric transducer for each nozzle, thereby generating a pressure pulse to expel the drops. U.S. Pat. No. 3,946,398 to Kyser et al., entitled "Method and Apparatus for Recording with Writing Fluids and Drop Projection Means Therefor", describes such a piezoelectric-based printing device. The patent to Kyser et al. discloses a drop-on-demand ink jet printer, wherein a high voltage is applied to a piezoelectric crystal, which causes the crystal to bend. When the crystal bends, pressure is applied and ink reservoir drops are thereafter expelled from the nozzle on demand. In both types of printers, thermal-based and piezoelectric-based, color rendition is accomplished by adding a few (e.g., typically three) color ink reservoirs and associated nozzle and ejection mechanisms so that that different colored dots may be overlaid on appropriate receiving media.

Continuous ink jet systems create a continuous stream of ink drops, generated by periodically perturbing the nozzle with, for example, a piezoelectric transducer. Continuous ink jet printers thus utilize electrostatic charging tunnels placed close to the position where ink droplets are ejected in the form of a stream. Selected droplets are electrically charged via the charging tunnels. The charged droplets are deflected downstream by the presence of deflector plates that have a predetermined electric potential difference between them.

A gutter may be used to intercept the charged droplets, while the uncharged droplets are free to strike the recording medium. Drops not utilized for printing are transferred to the gutter where they can be recycled. Such continuous ink jet printing systems have an advantage over other printing systems because they produce ink drops at a high frequency. However, continuous ink jet printing systems require complicated electrodes and high electromagnetic fields, in addition to the need for a cumbersome and awkward ink recirculation system to recycle unused ink.

The aforementioned printing techniques suffer from several notable drawbacks, including the difficulty to achieve continuous tone (i.e., grayscale) color reproduction. Dithering methods can be utilized to achieve continuous tone color reproduction. However, such dithering methods are utilized at the cost of lower resolution. Another method utilized to provide continuous tone color reproduction involves the deposition of multiple drops from one nozzle onto a single image pixel. However, this method suffers from uncertainty in the exact location of printed pixels because the receiver is typically in motion during printing thereby preventing multiple drops of ink from being released simultaneously.

Such continuous tone color reproduction methods also suffer from the prevalence of image artifacts on final printed images, because less dense image pixels, corresponding to smaller volumes of ink, do not occupy the same area on the receiver as high-density image pixels that correspond to larger volumes of ink. Failure to print pixels of equal area, regardless of image density, is known to produce visual artifacts in printed images.

Another continuous tone color reproduction method involves the use of more than one density of ink to increase the number of levels available for printing. U.S. Pat. No. 5,625,397 to Allred et al., entitled "Dot on Dot Ink Jet Printing Using Inks of Differing Densities," describes a method for utilizing two densities of ink, along with multiple droplet deposition, to increase the number of levels available. This method still suffers, to a lesser extent, from the problems mentioned above, as well as creating a new layer of complexity by requiring yet more ink reservoirs and nozzle arrays for each additional density of ink.

Other on-demand printing methods are also known. European Patent Application No. 96104789, describes a method for controlling the intensity in a piezoelectric ink jet drop-on-demand system. In this method, two chambers are connected. Ink in one chamber is injected into a second chamber utilizing a piezoelectric pressure pulse. The mixed fluid is then ejected from the second chamber via another piezoelectric pressure pulse. U.S. Pat. No. 5,606,351 to Hawkins, entitled "Altering the Intensity of the Color of Ink Jet Droplets" describes a method for controlling the intensity in a thermal ink jet drop-on-demand system wherein a secondary chamber containing ink is permitted to mix in a main chamber before the drop is fired.

In all of the above aforementioned printing methods, the number of available color levels is limited due to the number of drops and/or ink densities utilized in printing. In addition, ink is easily wasted. Those systems that do attempt to recycle the ink require complicated electrostatic charging, steering and gutter systems, which are expensive and costly to implement. The print heads utilized in such systems are also based on intricate arrangements of print head arrays, which make cleaning difficult and expensive. Additional nozzles are typically required for multiple ink drops on each pixel.

Based on the foregoing, it can be appreciated that a need exists for a continuous ink jet print head for use in a continuous ink jet printing system that results in improved quality color printed images without the problems that plague printing systems and methods such as those described above.

SUMMARY OF THE INVENTION

An object of the present invention is to provide improved image quality in continuous ink jet printing, wherein colored patterns of dots of varying intensities can be placed on a receiver while maintaining pixel size nearly constant on the receiver.

It is another object of the present invention to provide color mixing prior to any ink touching the receiver, utilizing a single nozzle for a three-color printing system.

It is still another object of the present invention to provide a simple monolithic print head.

It is yet another object of the present invention to provide an efficient print head cleaning method and system in which a carrier fluid is utilized to clean the print head without wasting ink.

It a further object present invention to provide a carrier fluid that does not contain ink, wherein the carrier fluid is mixed with ink in-flight to improve print quality on plain paper, without the use of additional nozzles or multiple drops of ink upon each pixel.

With these objects in view, the present invention resides in a continuous ink jet printer, comprising a continuous color ink jet print head composed of a nozzle, pressurized ink sources, and a print head surface having channels disposed therein such that each channel is in communication with the nozzle. The continuous color ink jet print head also includes a microvalve disposed within each of the channels, such that each channel is connected through the microvalve to a pressurized ink source. This configuration permits ink from the pressurized ink source to flow through the channel and thereafter be ejected from the nozzle when the pressurized ink source has attained a particular threshold pressure.

The pressurized ink source functions as an ink reservoir containing fluids in preparation for printing. A continuous jet is formed in the nozzle by the fluids. The microvalve is a thermally activated microvalve that permits colored patterns of dots of varying intensities to be ejected from the nozzle onto a receiver at a constant rate, thereby maintaining a static ink printed pixel size. A range of colored inks can be ejected from the nozzle onto the receiver by selectively controlling the length of time the microvalve is actuated.

A feature of the present invention involves the ability to provide a continuous tone scale for black and white and color images through ink mixing.

It is also a feature of this invention to provide a method for the fabrication of an improved ink jet print head with a minimum number of changes to present fabrication steps.

It is another feature of the invention to establish a method of fluid mixing for two or more fluid components drawn from reservoirs in a controlled manner, so as to achieve a continuous variability in the chemical properties of the mixture on a scale consistent with known print head technologies.

An advantage of the present invention includes an improvement in the color rendition of pictorial images, and the black and white rendition of text and images, particularly in image regions of low color density.

Another advantage of the present invention is an improvement in the speed of printing which may be achieved for a given image quality.

Another advantage of the present invention stems from the mixing of dyes or pigments in the fluid state in a single print head nozzle, so that the pigments and dyes are fully dispersed before application to the receiver.

An additional advantage of the present invention results from the fact that any chemical reactions of the mixed fluids occur in the fluid stream and not on the receiver, thereby affording greater variability in the nature type of receives which may be substituted for one another. The occurrence of chemical reactions in the mixed fluids within the fluid stream also affords greater variability in the nature and type of fluids effecting modulation of color intensity.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

FIG. 6(*b*) illustrates a top view of the patterning and etching of the first oxide layer of FIG. 5 to form a modified oxide layer on the silicon substrate, in accordance with a preferred embodiment of the present invention;

FIG. 7(*b*) illustrates a top view of the application of a resist layer to the silicon substrate of the continuous color ink jet print head, in accordance with a preferred embodiment of the present invention;

FIG. 11(*b*) depicts a top view of the deposition and patterning of lower actuator layers on the silicon substrate of the continuous color ink jet print head, in accordance with a preferred embodiment of the present invention;

DETAILED DESCRIPTION OF THE INVENTION

Figure 1:
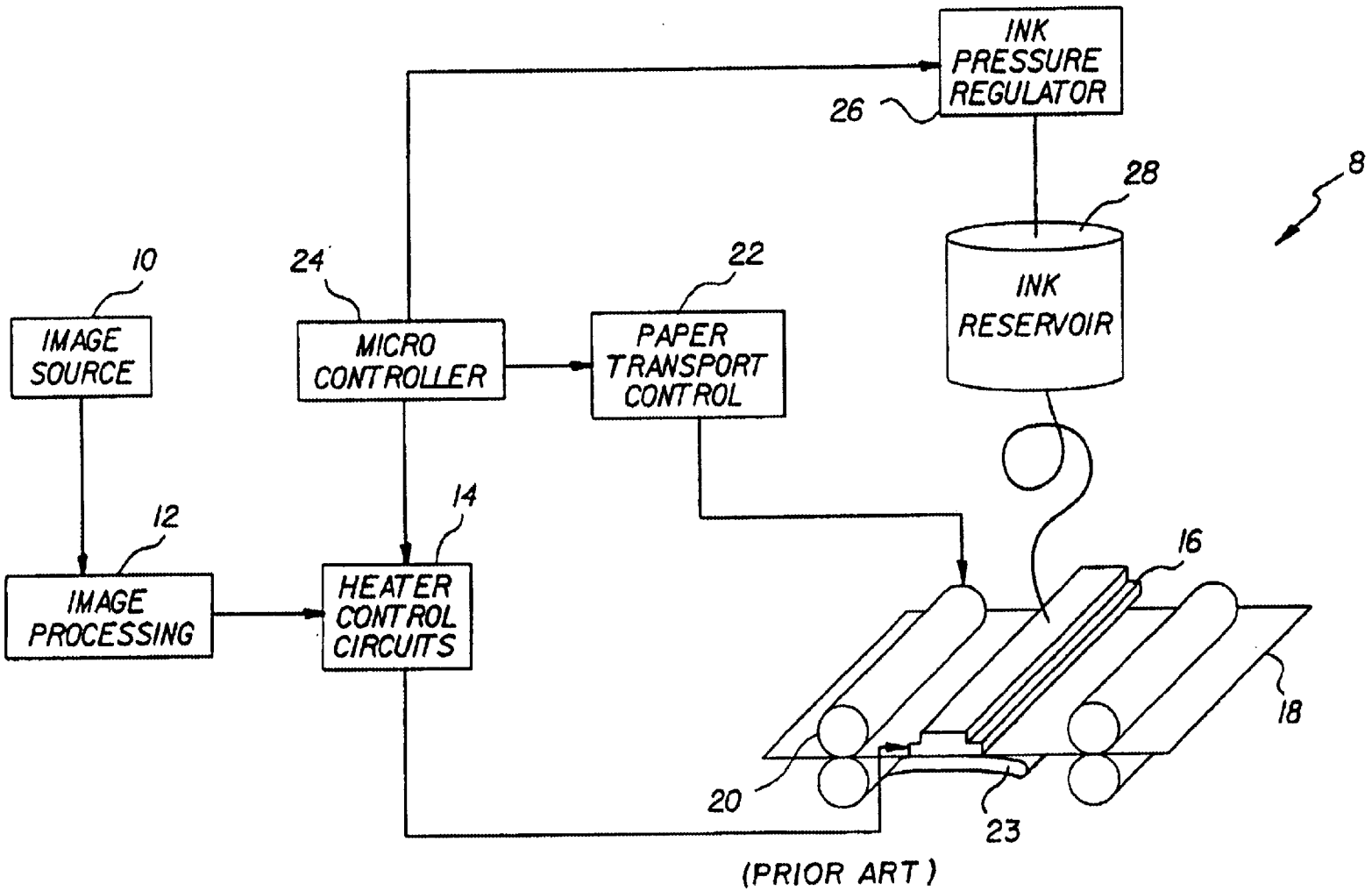
(PRIOR ART) FIG. 1
FIG. 1 illustrates a simplified block schematic diagram of one exemplary printing apparatus in which a preferred embodiment of the present invention may be implemented.

The present description will be directed in particular to elements forming part of, or cooperating more directly with, apparatus in accordance with the present invention. FIG. 1 illustrates a simplified block diagram of one exemplary printing apparatus in which a preferred embodiment of the present invention may be implemented. FIG. 1 depicts an ink transfer system 8 that utilizes a print head capable of producing a drop of controlled volume. An image source 10 may be composed of image data from a scanner or computer, or outline image data in the form of a page description language, or other forms of digital image representation. This image data is converted by an image-processing unit 12 to a map of the thermal activation necessary to provide the proper volume of ink for each pixel. This map is then transferred to image memory.

Heater control circuits 14 read data from the image memory and apply time varying or multiple electrical pulses to selected nozzle heaters that are part of a print head 16. These pulses are applied for an appropriate time, and to the appropriate nozzle, so that selected drops with controlled volumes of ink will form spots on a recording medium 18 after transfer in the appropriate position as defined by the data in the image memory. Recording medium 18 is moved relative to print head 16 by a paper transport roller 20, which is electronically controlled by a paper transport control system 22, which in turn is controlled by a micro-controller 24.

Recording medium 18 is tensioned against a platen 23, which contains a highly polished and optically flat surface to reduce friction with recording medium 18, and maintains positioning accuracy across the entire print region. Platen 23 may be alternatively formed by two or more rollers (not shown) to reduce friction further. The rollers may be surrounded by a band (not shown) to maintain positional accuracy of the recording medium.

A constant ink pressure can be achieved by applying pressure to an ink reservoir 28 under the control of an ink pressure regulator 26. Alternatively, for larger printing systems, the ink pressure can be very accurately generated and controlled by situating the top surface of the ink in reservoir 28 an appropriate distance above print head 16. A simple float valve (not shown) can regulate this ink level.

Figure 2:
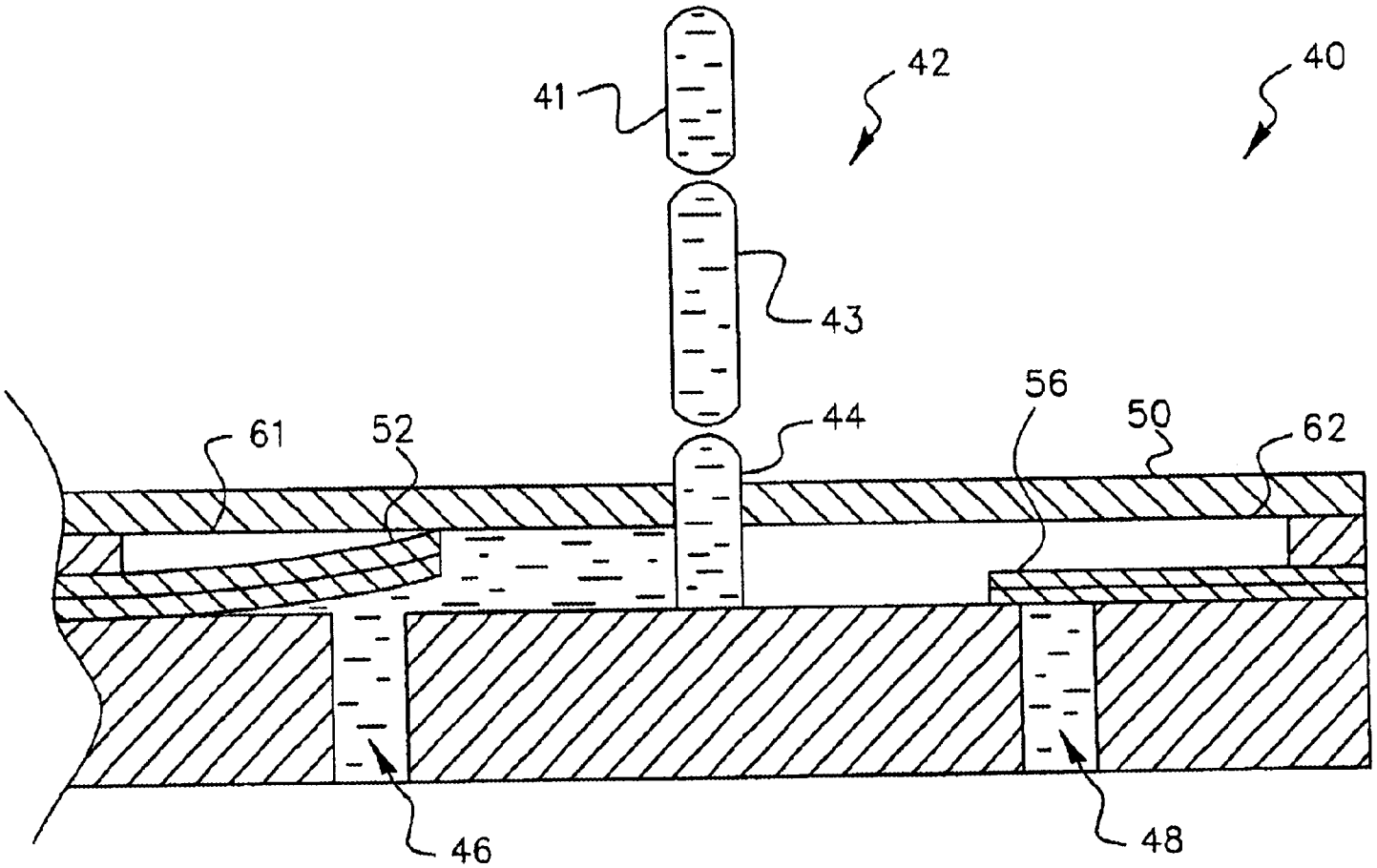
FIG. 2 depicts a side view of a continuous color ink jet print head, in accordance with a preferred embodiment of the present invention.

FIG. 2 depicts a side view of a continuous color ink jet print head 40, in accordance with a preferred embodiment of the present invention. Continuous color ink jet print head 40 illustrated in FIG. 2 may be implemented in a printing device, such as the ink transfer system 8 shown in FIG. 1. Continuous color ink jet print head 40 of FIG. 2 is analogous to print head 16 of FIG. 1, and includes a nozzle 42 and a group of pressurized ink sources, two of which are shown respectively in FIG. 2 as first and second ink reservoirs 46 and 48. Continuous color ink jet print head 40 also is composed of a print head surface 50 having channels disposed therein, wherein each channel is in communication with the nozzle. Two channels 61 and 62 are depicted in FIG. 2. However, two other channels, which run perpendicular to first channel 61 and second channel 62, are not illustrated in FIG. 2. Thus, a total of four channels are disposed on print head surface 50.

Those skilled in the art can of course appreciate that when continuous color ink jet print head 40 is implemented in the context of an ink transfer system, such as ink transfer system 8 depicted in the of FIG. 1, certain modifications to the composition of the ink transfer system may be necessary, such as replacing reservoir 28 and print head 16 with continuous color ink jet print head 40, which contains four associated ink reservoirs of its own. Thus, if continuous color ink jet print head 40 is implemented within the context of an ink transfer system such as that illustrated in FIG. 1, reservoir 28 can be removed and print head 16 configured as continuous color ink jet print head 40.

FIG. 1 merely illustrates a particular printing system in which the present invention may be implemented. Those skilled in the art will appreciate that the present invention may also be implemented in association with other printing systems not described herein. Thus, the example printing system depicted in FIG. 1 is presented for illustrative purposes only. It will be understood by those skilled in the art that various changes may be made and equivalents may be substituted for elements of the preferred embodiments of the present invention without departing from the sprit and scope of the invention described and claimed herein.

Microvalves 52 and 56 are disposed within a corresponding channel 61 and 62, respectively, such that each channel is connected through the microvalve to a pressurized ink source, thereby permitting ink from a pressurized ink source to flow through the channel and thereafter be ejected from the nozzle 42 when the pressurized ink source has attained a particular threshold pressure. Each microvalve functions as a thermally activated microvalve. In the example depicted in FIG. 2, second ink reservoir 48 contains ink of a particular color. However, second ink reservoir 48 is sealed closed by second microvalve 56. On the other hand, first ink reservoir 46 is open because first microvalve 52 is maintained in an open position.

At least one pressurized ink source (i.e., ink reservoir) contains a carrier fluid. In the example illustrated in FIG. 2, first ink reservoir 46 contains such a carrier fluid. Each pressurized ink source thus acts as an ink or fluid reservoir. The remaining pressurized ink sources contain varying colored inks. The ink stored within second ink reservoir 48 may, for example, be a magenta colored ink. Likewise other ink reservoirs may contain other colored inks, such as cyan or yellow.

A timing control mechanism (not depicted in FIG. 2) may be connected to the microvalves 52, 56. The timing control mechanism controllably permits a range of colored inks to be ejected from nozzle 42 by controlling the length of time a microvalve is actuated. The thermally activated microvalve (e.g., microvalves 52 or 56) permits colored patterns of dots of varying intensities to be ejected from the nozzle 42 onto a receiver at a constant rate, thereby maintaining a static ink printed pixel size. Because one of the four pressurized ink sources contains a carrier fluid (e.g., first ink reservoir 46) and the remaining three pressurized ink sources contain varying colors, color mixing occur prior to ejection of any ink from nozzle 42 onto the receiver. The timing control mechanism may also be connected to or integrated with a microcontroller, such as microcontroller 24 of FIG. 1, which in turn can be utilized to control the length time a microvalve is actuated.

The carrier fluid stored within first ink reservoir 46 may be composed of a solvent or water so that when first microvalve 52 connected to first ink reservoir 46 is activated, the ink from first ink reservoir 46 will flow through channel 61 and jet out of nozzle 42, passing through nozzle 42. The carrier fluid may be utilized to clean out nozzle 42.

Figure 3:
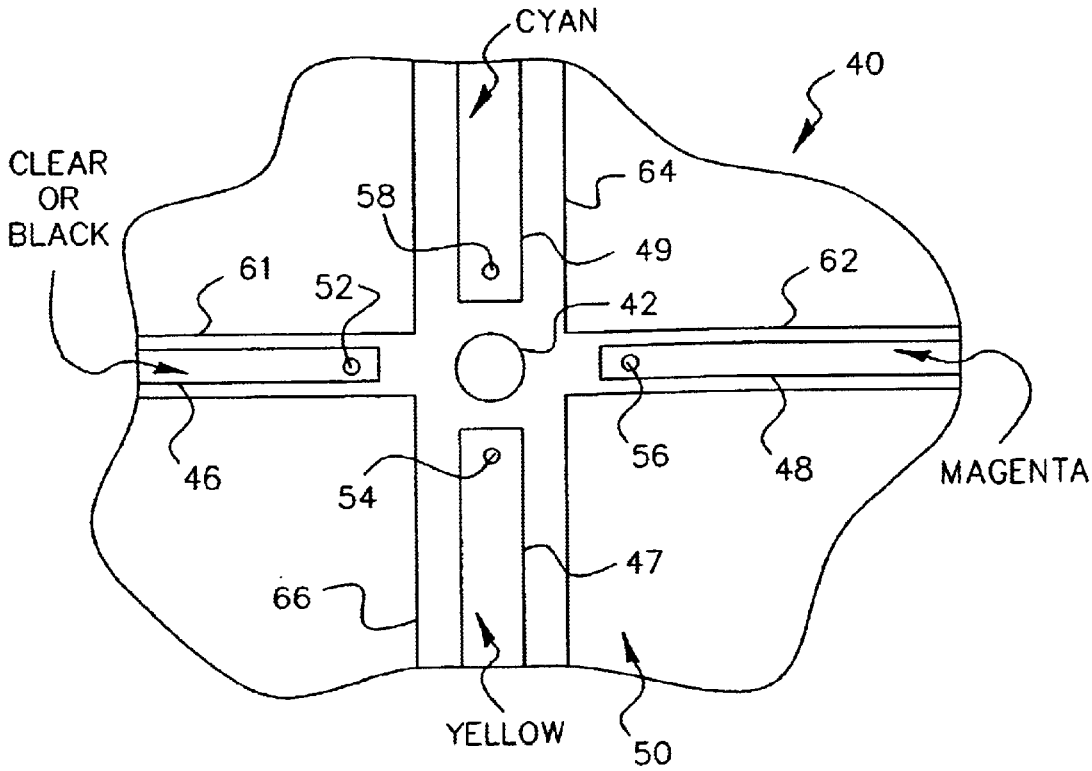
FIG. 3 illustrates a top view of the continuous color ink jet print head depicted in FIG. 1, in accordance with a preferred embodiment of the present invention.

FIG. 3 illustrates a top view of the continuous color ink jet print head 42 depicted in FIG. 2, in accordance with a preferred embodiment of the present invention. In FIG. 2 and FIG. 3, like parts are referenced by like reference numerals. FIG. 3 thus provides a better view of the four-channel system upon which continuous color ink jet print head 42 is based. Respective third and fourth channels 66 and 64 run perpendicular to first and second channels 61 and 62. In the example of FIG. 2 and FIG. 3, first ink reservoir 46 is composed of a black or clear fluid. If first ink reservoir 46 contains a clear fluid, the clear fluid is utilized to clean out nozzle 42.

Third channel 66 is connected by third microvalve 54 to third ink reservoir 47, which contains a yellow ink. Likewise, fourth channel 64 is connected by fourth microvalve 58 to fourth ink reservoir 49, which contains a cyan ink. Second channel 62 is connected by second microvalve 56 to second ink reservoir 48, which contains a magenta ink. Similarly, first channel 61 is connected by microvalve 52 to first ink reservoir 46 containing a carrier fluid, such as water, or simply black ink, in which case the cleaning function of the carrier fluid is not utilized in association with first ink reservoir 46. Continuous color ink jet print head 40 thus includes four microvalves, four channels, and four associated pressurized ink sources (i.e., four ink reservoirs).

Given a clear carrier fluid, such as water, a three-color system utilized in association with single nozzle 42 provides a method of cleaning continuous color inkjet print head 40 without wasting ink. The carrier fluid mixes with ink from the other reservoirs "in-flight" and as such, can be formulated to improve printing on plain paper, while not requiring additional nozzles or multiple drops on each pixel. Based on the foregoing, it can be appreciated that continuous color ink jet print head 40 is monolithic in nature, thereby removing the need for complicated electrostatic charging and steering, along with the need for collection and recycling of the ink by a gutter system. The monolithic nature of the continuous color ink jet print head 40 is evidenced by the fact that the print head requires only a single nozzle and four associated channels and ink reservoirs, thereby providing a unified integrated print head.

Figure 4:
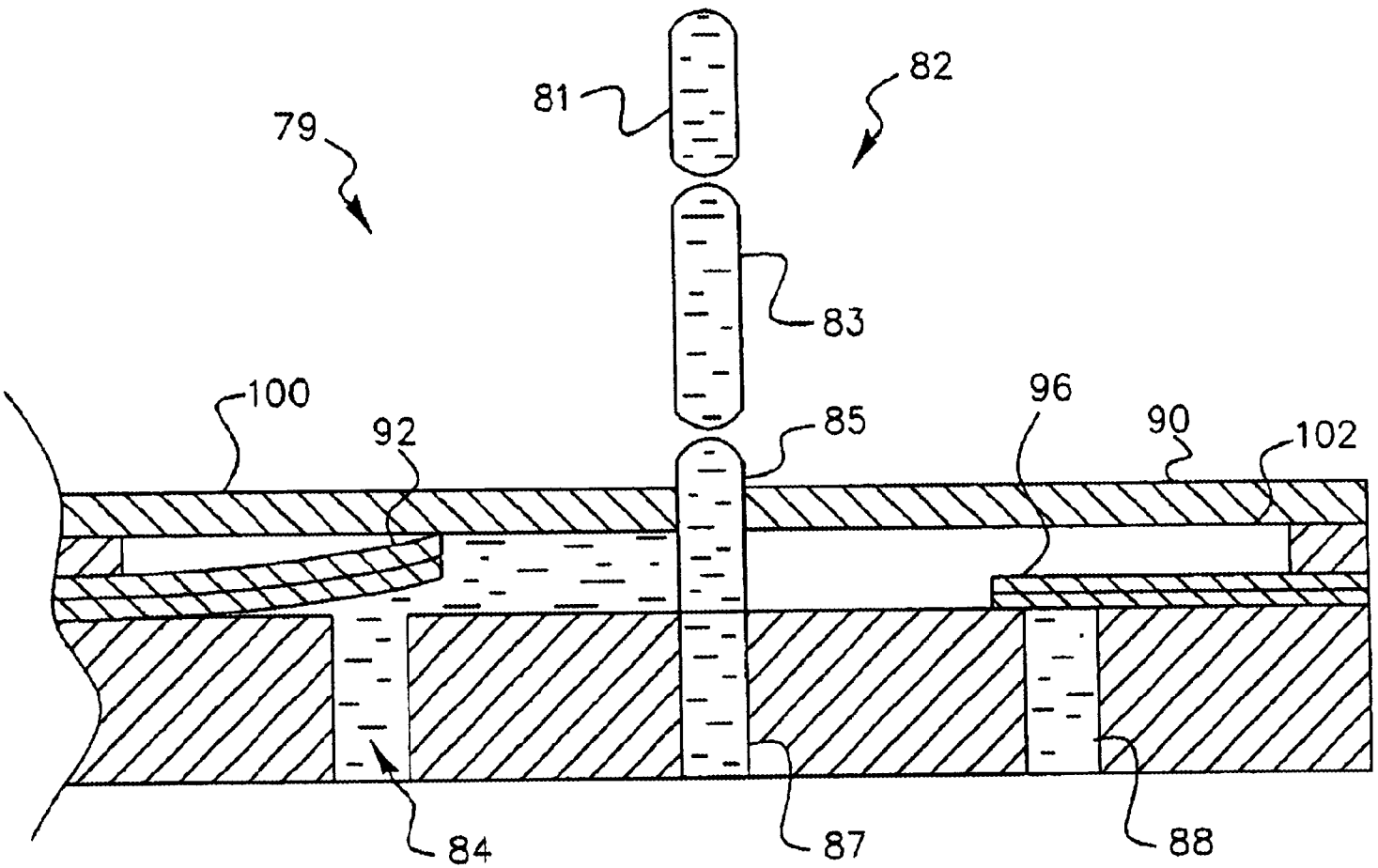
FIG. 4 depicts a top view of an alternative embodiment of a continuous color ink jet print head, in accordance with the present invention.

FIG. 4 depicts a top view of an alternative embodiment of a continuous color ink jet print head, denoted generally as 79, in accordance with the present invention. Continuous color ink jet print head 79 of FIG. 4 is analogous to continuous color ink jet print head 40 illustrated in FIG. 2 and FIG. 3 herein. As such, continuous color ink jet print head 79 may be implemented in a printing device, such as ink transfer system 8 of FIG. 1 and other printing systems not specifically illustrated or described herein. Continuous color ink jet print head 79 may be utilized in place of print head 16 of FIG. 1, provided that appropriate modifications are made to ink transfer system 8. Continuous color ink jet print head 79 includes a nozzle 82 and a group of pressurized ink sources, three of which are shown in FIG. 4 as ink reservoirs 84, 87 and 88. Ink and other fluids flow through each part of nozzle 82 before ejection from the nozzle.

Continuous color ink jet print head 79 also is composed of a print head surface 90 having channels disposed therein, wherein each channel is in communication with nozzle 82 at third nozzle part 85. Two channels 100 and 102 are depicted in FIG. 2. However, those skilled in the can appreciated, based on FIG. 2 and FIG. 3, that two additional channels also run perpendicular to channels 100 and 102, but are not illustrated in FIG. 4. Thus, a total of four channels are disposed on print head surface 90. A planar view of ink reservoir 87 is shown in FIG. 4 such that ink reservoir 87 sits within one of the channels that runs perpendicular to channels 100 and 102.

Microvalve 92 is disposed within channel 100, such that channel 100 is connected through microvalve 92 to a pressurized ink source (i.e. ink reservoir 84), thereby permitting ink from the pressurized ink source to flow through channel 100 and thereafter be ejected from nozzle 82 when the pressurized ink source has attained a particular threshold pressure. Microvalve 92, along with microvalve 96 and two other microvalves not shown in FIG. 4 function as thermally activated microvalves. The microvalves regulate the flow of inks or other fluids from the pressurized ink sources (i.e., ink reservoirs) by obstructing or opening access to the pressurized ink sources.

Ink reservoir 88 contains ink of a particular color (e.g., magenta). Ink reservoir 88 is sealed closed by microvalve 96. On the other hand, ink reservoir 84 is open because microvalve 92 is has been thermally forced into an open position due. Ink reservoir 87 may contain a carrier fluid, as described herein. The ink stored within ink reservoir 84 may contain a yellow or cyan colored ink. Likewise other ink reservoirs may contain other colored inks.

A timing control mechanism (depicted in FIG. 4) can be connected to the microvalve. Such a timing control mechanism controllably permits a range of colored inks to be ejected from nozzle 82 by controlling the length of time the microvalve is actuated. The thermally activated microvalve (e.g., microvalves 92 or 96) permits colored patterns of dots of varying intensities to be ejected from nozzle 82 onto a receiver at a constant rate, thereby maintaining a static ink printed pixel size.

Because one of the four pressurized ink sources contains a carrier fluid (e.g., ink reservoir 87) and the remaining three pressurized ink sources contain varying colors, color mixing occurs prior to ejection of any ink from nozzle 82 onto the receiver. Assuming that a microvalve associated with ink reservoir 84 is thermally activated, ink from ink reservoirs 84 and open ink reservoir 87 enter nozzle 82 and mix with one another, as indicated by the varying shading pattern illustrated at third nozzle part 85, second ink drop 83, and first ink drop 81. The mixed ink is then expunged from nozzle 82 according to the method and system described herein.

Based on the foregoing, it can be appreciated that the present invention describes a continuous color ink jet print head with a nozzle connected to four channels whose flow are controlled by thermally-activated microvalves. Each channel is connected through a microvalve to an ink reservoir containing, for example, cyan, magenta, yellow, and a clear fluid, which may be water or a solvent. Each ink reservoir is pressurized to a high enough pressure so that when then microvalve connected to the ink reservoir is activated, the ink flows through the channel and jets out of the nozzle.

By controlling the length of time each microvalve is actuated, or by simultaneously activating two or more microvalves, a controllably, continuous range of colors can be printed from the ink spewing from the nozzle. Since each nozzle can print the full range of color from black to white, there is no need for guttering and recycling of inks as in other continuous ink jet printers. Each nozzle is tied into a clear fluid, which can be used to clean out the nozzle without wasting ink. Because the clear fluid (i.e., carrier fluid) does not contain ink and mixes with the ink from other reservoirs "in-flight," the continuous color ink jet print head does not require additional nozzles or multiple drops on each pixel. The carrier fluid itself can be formulated to improve printing on plain paper.

The continuous color ink jet print head described herein also achieves a continuous tone scale for black and white and color images because of the ink mixing that occurs "in-flight" within the nozzle. This in-flight mixing in turn leads to improvements in the color rendition of pictorial images, and in the rendition of black and white text and images, particularly in image regions of low color density. Because the mixing of dyes or pigments occurs in the fluid state, the pigments and dyes are fully dispersed prior to application on the receiver or receiving medium. Any chemical reactions of the fluids so mixed occur in the fluid stream and not on the receiver or receiving medium itself, thereby affording greater variability in the nature and type of receivers that may be substituted during the printing process. In addition, greater variability in the nature and type fluids whose mixing effects modulation of color intensity is also a natural result of any chemical reactions of the fluids so mixed occurring in the fluid stream.

Thus, the continuous color ink jet print head is capable of generating high photo quality output. By decreasing the number of nozzles required, improvements in printing speeds are also realized, in addition to improvements in image quality. Continuous color ink jet 40, for example, as illustrated in FIG. 2 and FIG. 3, includes only a single nozzle. Additionally, by achieving the fluid mixing of two or more fluids drawn from reservoirs in a controlled manner, the continuous color ink jet print head described herein achieves a continuous variability of the chemical properties of the ink or fluid mixture on a size scale consistent with that known in the print head arts, namely channels in the width range of 2 to 50 micrometers. Fabrication of the continuous color ink jet print head itself can be realized with a minimum of changes to fabrication steps already well established in the print head and printing arts.

Figure 5:
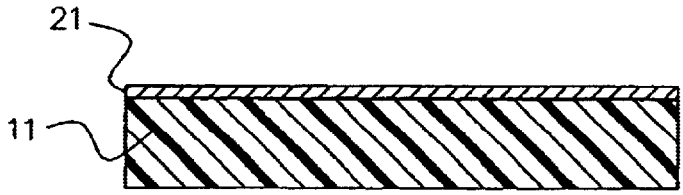
FIG. 5 illustrates a side view of the formation of a first oxide layer on a silicon substrate for a continuous color ink jet print head, in accordance with a preferred embodiment of the present invention.
Figure 6A:
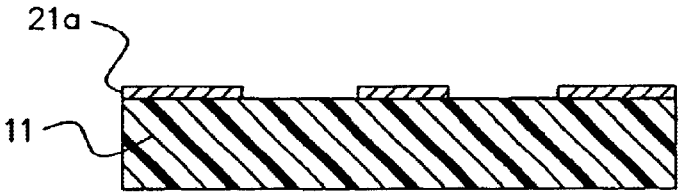
FIG. 6(*a*) depicts a side view of the patterning and etching of the first oxide layer of FIG. 5 to form a modified oxide layer on the silicon substrate, in accordance with a preferred embodiment of the present invention.
Figure 6B:
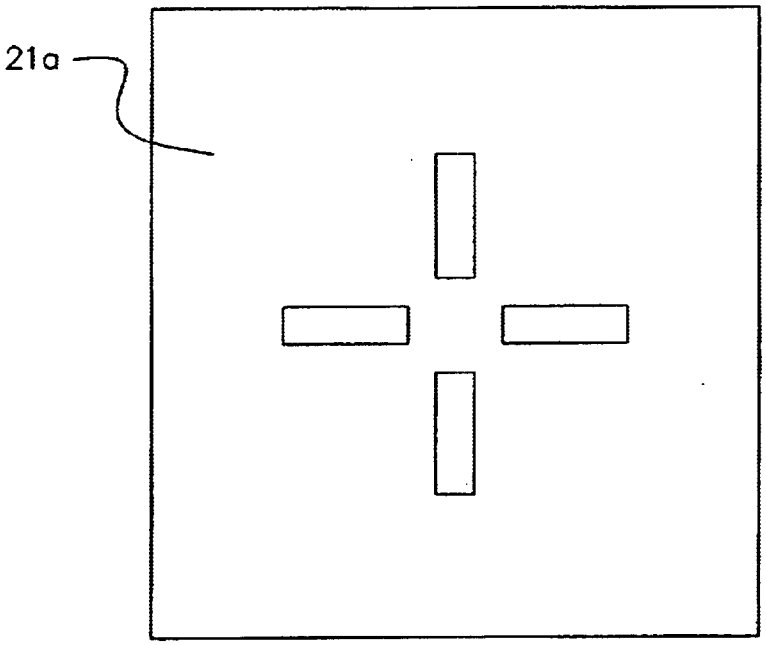

FIG. 5 illustrates a side view of the formation of a first oxide layer 21 on a silicon substrate 11 of a continuous color ink jet print head, in accordance with a preferred embodiment of the present invention. FIG. 5 depicts the initial step necessary in the formation of a continuous color ink jet print head. First oxide layer 21 is formed preferably in the thickness range of 0.1 to 1 micron on silicon substrate 11. The oxide layer is patterned and etched to form a modified oxide layer 21*a* containing rectangular openings, as illustrated in FIGS. 6(*a*) and FIG. 6(*b*). Those skilled in the art will appreciate that FIG. 5 to FIG. 17 illustrate methods steps that may be utilized in the formation of a continuous print head, such as the continuous color ink jet print head described herein. Those skilled in the art will further appreciate that although the method for forming a continuous color ink jet print head, as described in FIG. 5 to FIG. 17, may be implemented in accordance with a preferred embodiment of the present invention, other formation method steps may also be followed to form the continuous color ink jet print head described and claimed herein.

FIG. 6(*a*) depicts a side view of the patterning and etching of the first oxide layer 21 of FIG. 5 to form modified oxide layer 21 a on silicon substrate 11, in accordance with a preferred embodiment of the present invention. FIG. 6(*b*) illustrates a top view of the patterning and etching of the first oxide layer of FIG. 5 to form modified oxide layer 21*a* on silicon substrate 11, in accordance with a preferred embodiment of the present invention. Those skilled in the art will appreciate that in FIG. 5 to FIG. 20 as described herein, similar parts are indicated by similar reference numerals.

Figure 7A:
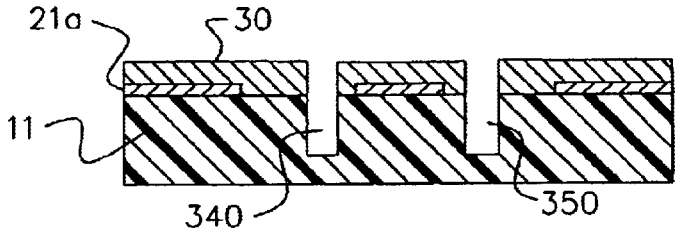
FIG. 7(*a*) depicts a side view of the application of a resist layer to the silicon substrate of the continuous color ink jet print head, in accordance with a preferred embodiment of the present invention.
Figure 7B:
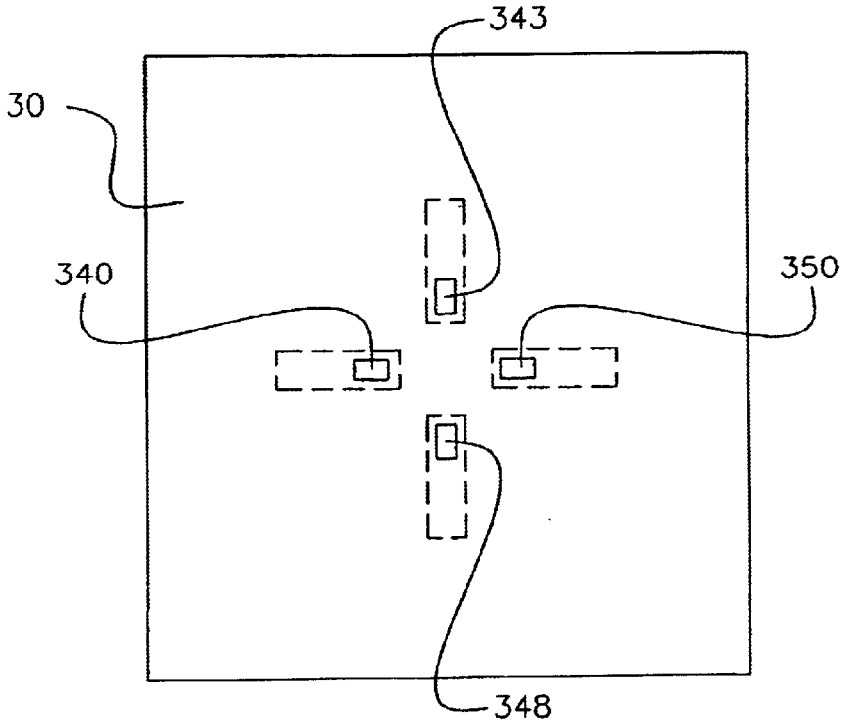

Following the formation of first oxide layer 21, a resist layer 30, as depicted in FIG. 7(*a*) and FIG. 7(*b*), is applied to silicon substrate 11 by spin coating, an application technique well known in the art. FIG. 7(*a*) depicts a side view of the application of resist layer 30 to silicon substrate 11 of the continuous color ink jet print head, in accordance with a preferred embodiment of the present invention. FIG. 7(*b*) illustrates a top view of the application of resist layer 30 to silicon substrate 11, in accordance with a preferred embodiment of the present invention. Resist layer 30 is thus applied by spin coating and lithographically patterned on silicon substrate 11. This pattern is etched into silicon substrate 11 to form first through fourth actuator feed slots 340, 343, 348, and 350. First through fourth actuator feed slots 340, 343, 348 and 350 are formed within openings of modified oxide layer 21*a,* preferably in the depth range of 25 to 100 microns.

Figure 8:
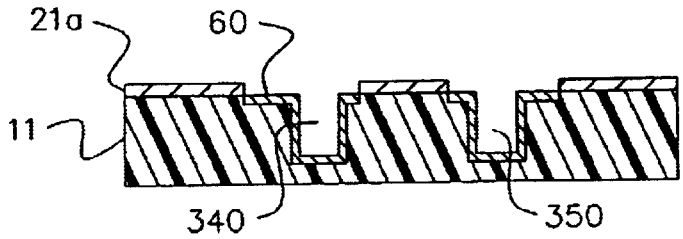
FIG. 8 depicts a side view of the silicon substrate in which the resist layer is stripped and a conforming second layer is grown, in accordance with a preferred embodiment of the present invention.

FIG. 8 depicts a side view of silicon substrate 11 in which resist layer 30 is stripped and a conforming second oxide layer 60 is grown, in accordance with a preferred embodiment of the present invention. Following the formation of first through fourth actuator feed slots 340, 343, 348 and 350 within the openings of modified oxide layer 21*a,* resist layer 30 is stripped and the second oxide layer 21 is grown thereon.

Figure 9:
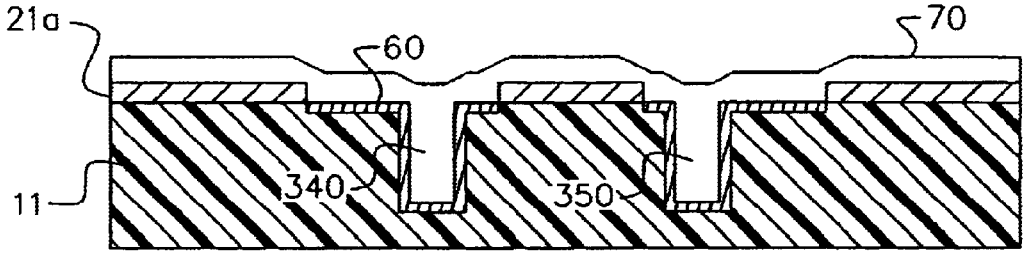
FIG. 9 illustrates a side view of the deposition of a first sacrificial layer, in accordance with a preferred embodiment of the present invention.

Thereafter, as depicted in FIG. 9, a first sacrificial layer 70 is deposited. FIG. 9 illustrates a side view of the deposition of first sacrificial layer 70, in accordance with a preferred embodiment of the present invention. The deposited thickness is enough to completely fill actuator feed slots 340, 343, 348 and 350 as well as the rectangular openings of modified oxide layer 21*a.* Those skilled in the art will appreciate that various materials may be utilized to form modified oxide layer 21*a.* For example, modified oxide layer 21*a* may be composed of polysilicon. Alternatively, polymide may be utilized to form modified oxide layer 21*a*.

Figure 10:
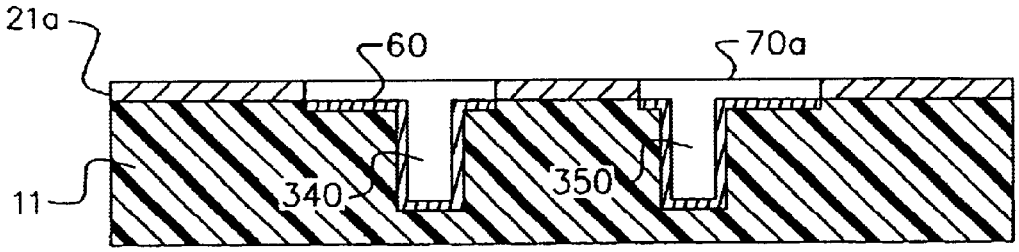
FIG. 10 depicts a view in which the first sacrificial layer is made planar to a modified oxide layer by chemical mechanical polishing, in accordance with a preferred embodiment of the present invention.

First sacrificial layer 70 is thereafter positioned planar to modified oxide layer 21*a*. FIG. 10 depicts a view in which first sacrificial layer 70 is made planar to modified oxide layer 70 by chemical mechanical polishing, in accordance with a preferred embodiment of the present invention. The chemical mechanical processing is designed to etch first sacrificial layer 70 and halt at modified oxide layer 21*a,* thereby creating a planarized first sacrificial layer 70*a*.

Figure 11A:
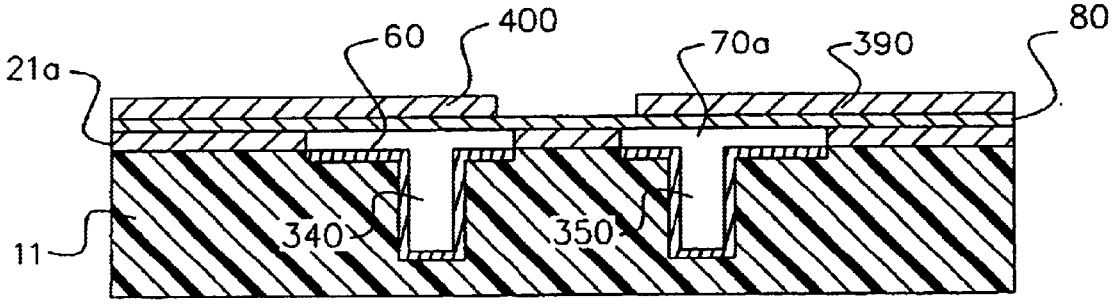
FIG. 11(*a*) illustrates a side view of the deposition and patterning of lower actuator layers on the silicon substrate of the continuous color ink jet print head, in accordance with a preferred embodiment of the present invention.
Figure 11B:
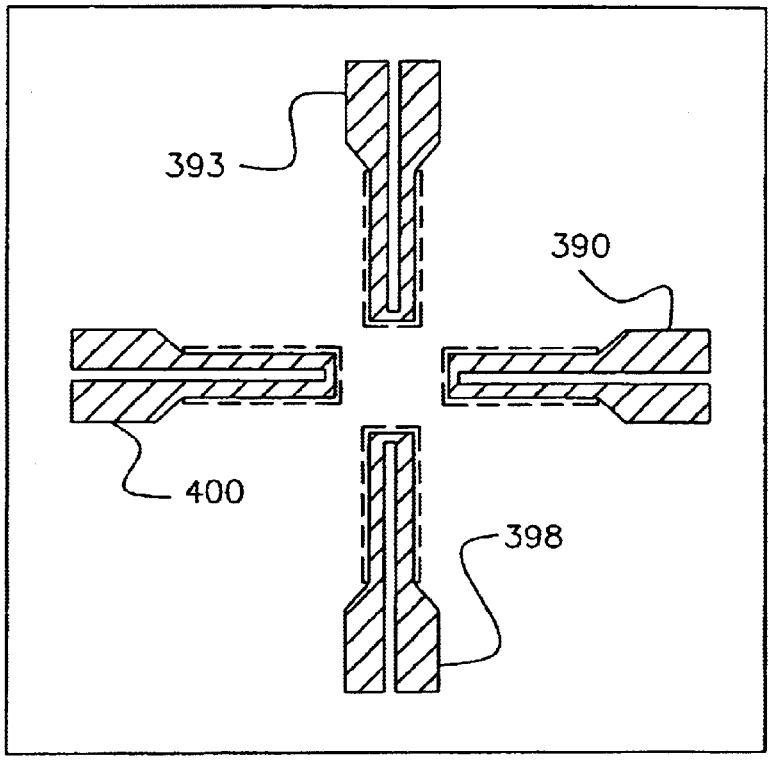

FIG. 11(*a*) illustrates a side view of the deposition and patterning of lower actuator layers on silicon substrate 11, in accordance with a preferred embodiment of the present invention. FIG. 11(*b*) depicts a top view of the deposition and patterning of lower actuator layers on silicon substrate 11, in accordance with a preferred embodiment of the present invention. As illustrated in FIG. 11(*a*) and FIG. 11(*b*), a third oxide layer 80 is deposited preferably in the thickness range of 0.1 to 1 micron. This deposition step is followed by the deposition and patterning of lower actuator layer 390, 393, 398 and 400.

Criteria for lower actuator layers 390, 393, 398, and 400 include a high coefficient of thermal expansion, resistivity between 3 to 1000 $\mu\Omega$-cm, a high modulus of elasticity, low mass density, and low specific heat. Metals such as aluminum, copper, nickel, titanium and tantalum, as well as alloys of these metals meet such requirements. In a preferred embodiment of the present invention, an aluminum alloy may be utilized to meet such requirements, although those skilled in the art can appreciate that other metals may also be utilized in place of the aluminum alloy.

Figure 12:
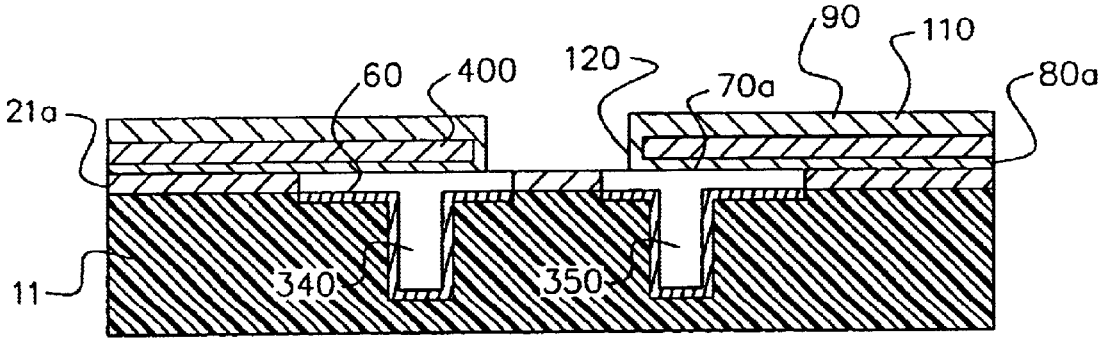
FIG. 12 illustrates a side view of the deposition and removal of an upper actuator layer from areas above a planarized first sacrificial layer, in accordance with a preferred embodiment of the present invention.

As illustrated thereafter at FIG. 12, an upper actuator layer 110 is then deposited and consequently removed in areas above planarized first sacrificial layer 70*a,* except for material deposited on lower actuator layer 390 and a small protective region 120 adjacent lower actuator layer 390. FIG. 12 thus illustrates a side view of the deposition and removal of upper actuator layer 110 from areas above planarized first sacrificial layer 70*a,* in accordance with a preferred embodiment of the present invention. Third oxide layer 80 is also removed from the same regions, thereby resulting in the creation of modified third oxide layer 80*a.* Criteria for the formation of upper actuator layer 400 include a low coefficient of thermal expansion, and electrical insulating properties. Upper actuator layer 400 should be electrically insulating. Dielectric materials, such as oxides and silicon nitride, meet these requirements. In a preferred embodiment of the present invention, the dielectric material utilized is composed of an oxide. Protective region 120, along with modified third oxide layer 80*a,* completely enclose lower actuator layer 80, thereby protecting it from the ink.

Figure 13:
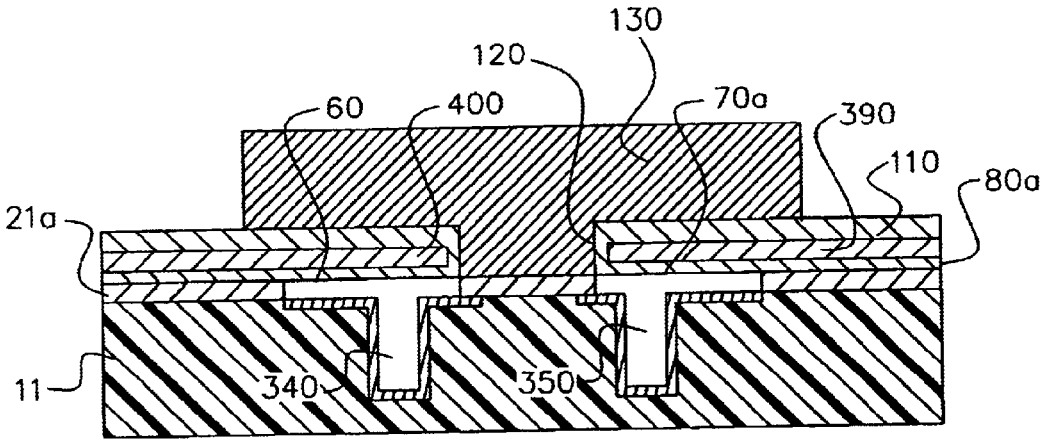
FIG. 13 depicts a side view of the deposition and patterning of a second sacrificial layer on the aforementioned silicon substrate, in accordance with a preferred embodiment of the present invention.

A second sacrificial layer 130 is then deposited and lithographically patterned. FIG. 13 depicts a side view of the deposition and patterning of second sacrificial layer 130 on silicon substrate 11, in accordance with a preferred embodiment of the present invention. In a preferred embodiment of the present invention, second sacrificial layer 130 may be composed of a photo-imageable polymide. This material can be spun on and patterned by masked exposure and development techniques. The material is then finally cured at 350 C to provide a layer preferably in the thickness range of 2–10 microns. A slight etchback in oxygen plasma can be performed to adjust the final thickness and descum the surface.

Figure 14:
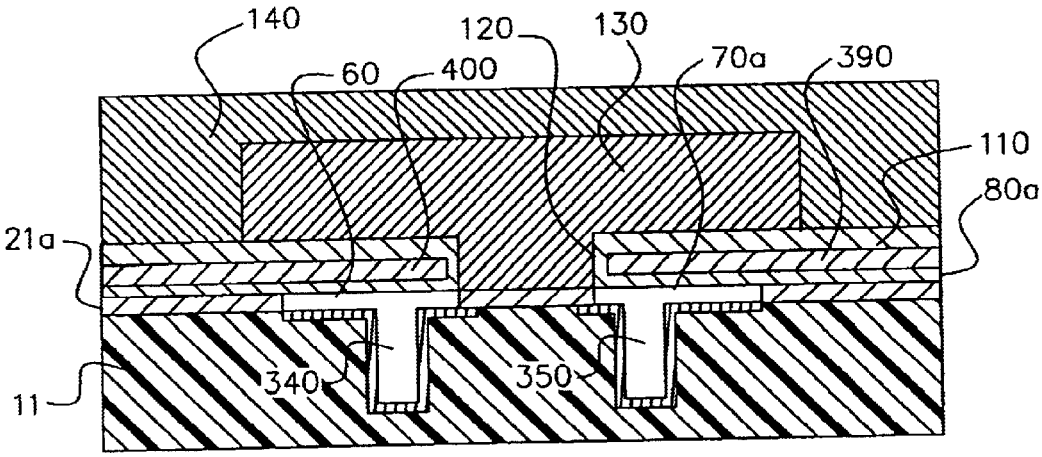
FIG. 14 illustrates a side view of a the planarization of a wall layer, in accordance with a preferred embodiment of the present invention.

As indicated thereafter in FIG. 14, a thick chamber wall layer 140 is then deposited with a preferred thickness so that all regions between second sacrificial layer 130 are filled up and possess a thickness on top of second sacrificial layer 130 greater than 1 micron. In a preferred embodiment of the present invention, chamber wall layer 140 is composed of an oxide layer. Other materials, however, such as silicon nitride or oxynitrides or combinations thereof, may be utilized to form chamber wall layer 140. This layer can then be planarized via chemical mechanical polishing with a preferred final thickness above second sacrificial layer 130 in the range of 2 to 20 microns. FIG. 14 thus illustrates a side view of a the planarization of chamber wall layer 140, in accordance with a preferred embodiment of the present invention.

Figure 15:
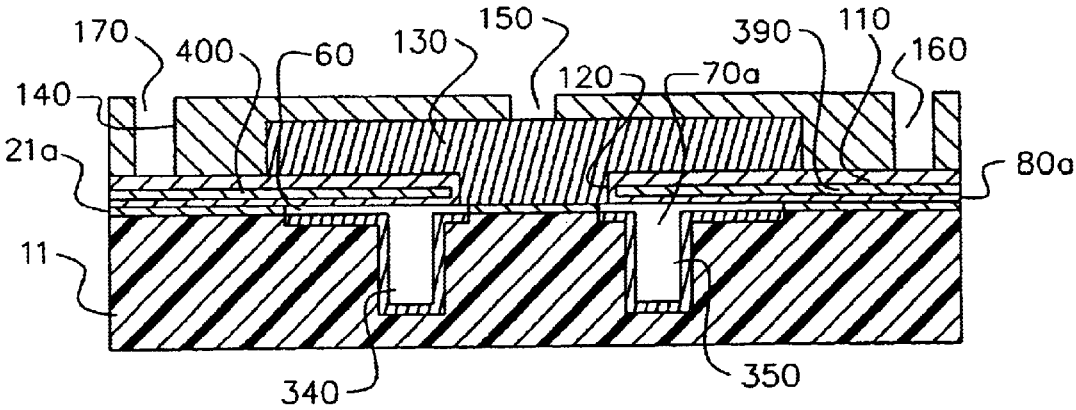
FIG. 15 depicts a side view of an etched chamber wall layer on the silicon substrate in accordance with a preferred embodiment of the present invention.
Figure 16:
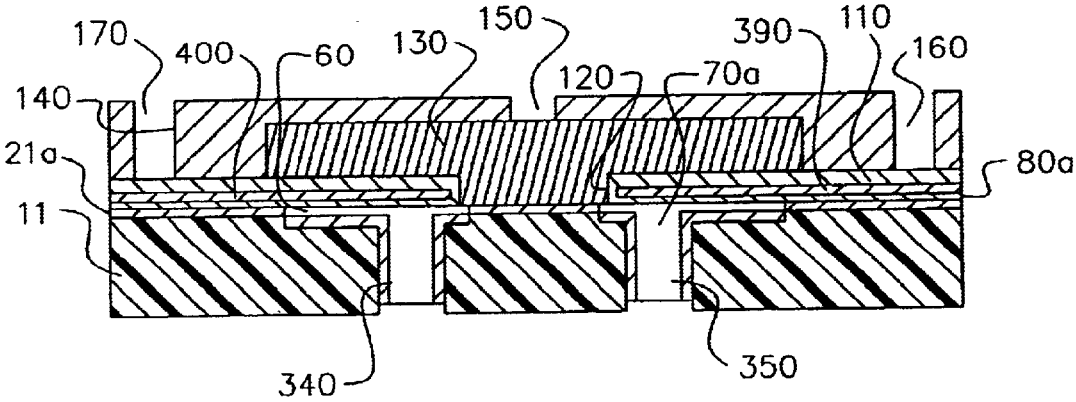
FIG. 16 illustrates a side view of the back side of the silicon substrate described herein, wherein the back side is thinned down to the line oxide coating the bottoms of actuator feed slots, in accordance with a preferred embodiment of the present invention.

As illustrated next in FIG. 15, chamber wall layer 140 is then patterned and etched to form nozzle 150 for the ejection of ink. The etch also opens up vias 160 and 170 down to lower actuator layers 390 and 400 respectively so that contact can be made to them. FIG. 15 depicts a side view of etched chamber wall layer 140 on silicon substrate 11 in accordance with a preferred embodiment of the present invention. The back side of silicon substrate 11 is then thinned down to the linear oxide 60 coating the bottoms of actuator feed slots 340, 343, 348 and 350, as depicted in FIG. 16. FIG. 16 illustrates a side view of the backside of silicon substrate 11. The thinned backside surface is then patterned and linear oxide 60 coating the bottoms of actuator feed slots 340, 343, 348 and 350 is removed.

Figure 17:
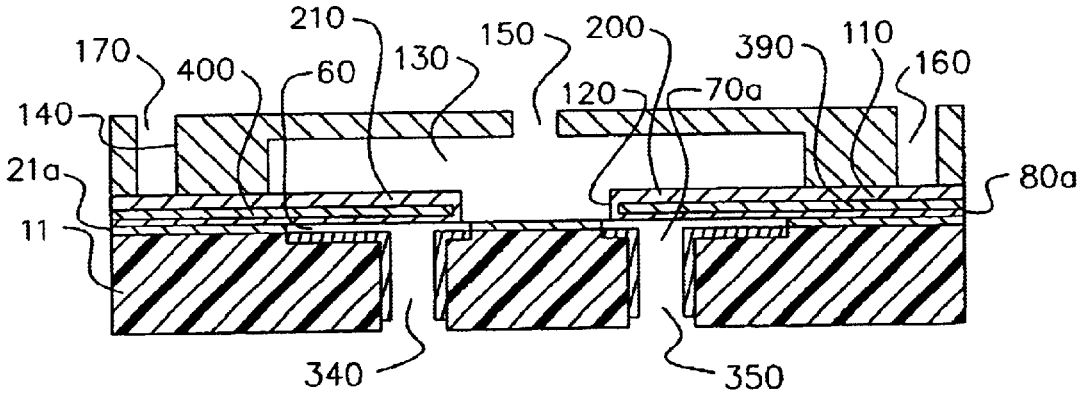
FIG. 17 depicts the removal of the first sacrificial layer and second sacrificial layer by plasma etchants, in accordance with a preferred embodiment of the present invention.

First sacrificial layer 70 and second sacrificial layer 130 are then removed by plasma etchants, which do not attack chamber wall layer 140. For polymide sacrificial layers, an oxygen plasma may be utilized. For polysilicon sacrificial layers, $XeF_2$ or $SF_6$ may be utilized. As depicted in FIG. 17, this step involves the release of thermal actuators 200 and 210. FIG. 17 illustrates the removal of first sacrificial layer 70 and second sacrificial layer 130 by plasma etchants, in accordance with a preferred embodiment of the present invention.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention.

PARTS LIST

| | |
|---|---|
| 8 | ink transfer system |
| 10 | image source |
| 11 | silicon substrate |
| 12 | image-processing unit |
| 14 | heater control circuits |
| 16 | print head |
| 18 | recording medium |
| 20 | paper transport roller |
| 21 | first oxide layer |
| 21a | modified oxide layer |
| 22 | paper transport control system |
| 23 | platen |
| 24 | microcontroller |
| 26 | ink pressure regulator |
| 28 | reservoir |
| 30 | resist layer |
| 40 | continuous color ink jet print head |
| 41 | first nozzle part |
| 42 | nozzle |
| 43 | second nozzle part |
| 44 | third nozzle part |
| 46 | first ink reservoir |
| 47 | third ink reservoir |
| 48 | second ink reservoir |
| 49 | fourth ink reservoir |

-continued

| PARTS LIST | |
|---|---|
| 50 | print head surface |
| 52 | first microvalve |
| 54 | third microvalve |
| 56 | second microvalve |
| 58 | fourth microvalve |
| 60 | second oxide layer |
| 61 | first channel |
| 62 | second channel |
| 64 | fourth channel |
| 66 | third channel |
| 70 | first sacrificial layer |
| 70a | planarized first sacrificial layer |
| 79 | continuous color ink jet print head |
| 80 | third oxide layer |
| 80a | modified oxide layer |
| 81 | first nozzle part |
| 82 | nozzle |
| 83 | second nozzle part |
| 84 | ink reservoir |
| 87 | ink reservoir |
| 88 | ink reservoir |
| 90 | print head surface |
| 92 | microvalve |
| 96 | microvalve |
| 100 | channel |
| 102 | channel |
| 110 | upper actuator layer |
| 120 | protective region |
| 130 | second sacrificial layer |
| 140 | chamber wall layer |
| 160 | via |
| 170 | via |
| 200 | thermal actuator |
| 210 | thermal actuator |
| 340 | actuator feed slot |
| 343 | actuator feed slot |
| 348 | actuator feed slot |
| 350 | actuator feed slot |
| 390 | lower actuator layer |
| 393 | lower actuator layer |
| 398 | lower actuator layer |
| 400 | lower actuator layer |

What is claimed is:

1. A continuous color ink jet print head for an electronic printing device, said continuous color ink jet print head comprising:

a nozzle;

a plurality of pressurized ink sources each having a fluid under pressure sufficient to eject a continuous flow of said fluid from said pressurized ink sources through said nozzle;

a plurality of channels connected in fluid communication to said nozzle, each of said channels being connected in fluid communication to at least one of said plurality of pressurized ink sources; and a thermally activated microvalve disposed within each of said channels such that flow of fluid from each of said plurality of pressurized ink sources through said nozzle is controlled by said microvalve, said microvalve having an open position, wherein fluid is permitted to be continuously ejected from at least one of said plurality of pressurized ink sources through said nozzle when said microvalve is in said open position.

2. The continuous color ink jet print head of claim 1 wherein at least one pressurized ink source among said pressurized ink sources contains a carrier fluid.

3. The continuous color ink jet print head of claim 2 wherein at least one pressurized ink source among said pressurized ink sources contains a particular colored ink.

4. The continuous color ink jet print head of claim 3 further comprising a timing control mechanism connected to said microvalve wherein said timing control mechanism controllably permits a range of colored inks to be ejected from said nozzle by controlling a length of time said microvalve is actuated.

5. The continuous color ink jet print head of claim 4 wherein said thermally activated microvalve comprises a microvalve that permits colored patterns of dots of varying intensities to be ejected from said nozzle onto a receiver at a constant rate, thereby maintaining a static ink printed pixel size.

6. The continuous color ink jet print head of claim 5 wherein said continuous color ink jet print head comprises a monolithic print head.

7. The continuous color ink jet print head of claim 6 wherein said plurality of at pressurized ink sources comprises four pressurized ink sources wherein one of said four pressurized ink sources contains said carrier fluid and three of said four pressurized ink sources contain varying colors, thereby permitting color mixing to occur prior to ejection of any ink from said nozzle onto said receiver.

8. The continuous color ink jet print head of claim 6 wherein said carrier fluid comprises a solvent.

9. The continuous color ink jet print head of claim 6 wherein said carrier fluid comprises water.

10. A method in an electronic printing device for causing a continuous flow of ink drops to be expelled from a continuous color ink jet print head, said method comprising:

providing a nozzle in said continuous color ink jet print head so that ink drops can be ejected from said nozzle;

providing a plurality of channels in communication with said nozzle to deliver ink under pressure sufficient to expel a drop; and selectively operating a thermally activated microvalve within at least one of said channels, each channel being connected through said microvalve to at least one pressurized ink source among a plurality of pressurized ink sources, said microvalve having an open position, wherein an ink drop is permitted to be continuously ejected through said nozzle when said microvalve is in said open position.

11. The method of claim 10 further comprising the step of placing a carrier fluid within at least one pressurized ink source among said plurality of pressurized ink sources.

12. The method of claim 11 further comprising the step of placing a particular colored ink within at least one pressurized ink source among said plurality of pressurized ink sources.

13. The method of claim 12 further comprising the step of selectively controlling a length of time said microvalve is actuated in order to controllably permit a range of colored inks to be ejected from said nozzle.

14. The method of claim 13 further comprising the step of ejecting colored patterns of dots of varying intensities from said nozzle onto a receiver at a constant rate, thereby maintaining a static ink printed pixel size, in response to selectively controlling said length of time said microvalve is actuated.

15. The method of claim 14 wherein the step of providing a plurality of channels within a print head surface of said continuous color ink jet print head, further comprises the step of providing said plurality of channels within a print head surface of said continuous color ink jet print head such that said continuous color ink jet print head comprises a monolithic print head.

16. The method of claim 15 further comprising the step of:

configuring said plurality of pressurized ink sources as a configuration of four pressurized ink sources, wherein one of said four pressurized ink sources contains said carrier fluid and three of said four pressurized ink sources contain varying colors, thereby permitting color mixing to occur prior to ejection of any ink from said nozzle onto said receiver.

17. The method of claim 15 further comprising the step of configuring said carrier fluid to comprise a solvent.

18. The method of claim 15 further comprising the step of configuring said carrier fluid to comprise water.

19. A method of assembling a continuous color ink jet printhead having a single nozzle and a print head surface, said method comprising attaching said nozzle to said continuous color ink jet print head, wherein ink can be ejected from said nozzle;

providing a plurality of channels in communication with said nozzle;

connecting each of said channels to at least one pressurized ink source from among a plurality of pressurized ink sources, said plurality of pressurized ink sources being sufficiently pressurized to expel ink; and disposing a thermally activated microvalve within each of said channels, such that each channel is connected through said microvalve to at least one pressurized ink source among said plurality of pressurized ink sources, said microvalve having an open position, wherein ink is permitted to be continuously ejected through said nozzle when said microvalve is in said open position.

20. The method of claim 19 further comprising the step of placing a carrier fluid within at least one pressurized ink source among said plurality of pressurized ink sources.

21. The method of claim 20 further comprising the step of placing a particular colored ink within at least one pressurized ink source among said plurality of pressurized ink sources.

22. The method of claim 21 further comprising the step of configuring a timing control mechanism to selectively control a length of time said microvalve is actuated in order to controllably permit a range of colored inks to be ejected from said nozzle.

23. The method of claim 22 further comprising the step of configuring said nozzle to eject colored patterns of dots of varying intensities from said nozzle onto a receiver at a constant rate, thereby maintaining a static ink printed pixel size.

24. The method of claim 23 further comprising the step of configuring said continuous color ink jet print head as a monolithic print head.

25. The method of claim 24 wherein the step of configuring a timing control mechanism to selectively control a length of time said microvalve is actuated in order to controllably permit a range of colored inks to be ejected from said nozzle, further comprises the step of connecting said timing control mechanism to said microvalve.

26. The method of claim 25 further comprising the step of configuring said plurality of pressurized ink sources as a configuration of four pressurized ink sources, wherein one of said four pressurized ink sources contains said carrier fluid and three of said four pressurized ink sources contain varying colors, thereby permitting color mixing to occur prior to ejection of any ink from said nozzle onto said receiver.

27. The method of claim 26 further comprising the step of configuring said carrier fluid to comprise a solvent.

28. The method of claim 26 further comprising the step of configuring said carrier fluid to comprise water.

29. A continuous color ink jet print head for an electronic printing device, said continuous color ink jet print head comprising:

a nozzle;

a first channel connected to said nozzle;

a pressurized carrier fluid source in fluid communication with said nozzle through said first channel, said pressurized carrier fluid source having a carrier fluid under pressure sufficient to eject a continuous flow of said carrier fluid from said pressurized carrier fluid source through said nozzle;

a second channel connected to said nozzle, said second channel having a thermally activated microvalve disposed therein, said microvalve having an open position; and a pressurized ink source in communication with said nozzle through said second channel, said pressurized ink source having an ink under pressure sufficient to eject a continuous flow of said ink from said pressurized ink source through said nozzle, wherein said ink is permitted to continuously flow from said pressurized ink source through said second channel and mix with said carrier fluid prior to being ejected from said nozzle when said microvalve is in said open position.

30. The continuous color ink jet print head of claim 29, wherein said thermally activated microvalve is operable to permit ink to be ejected from said nozzle in varying intensities at a constant rate, thereby maintaining a static printed pixel size.

31. The continuous color ink jet print head of claim 29, further comprising:

a timing control mechanism operably connected to said thermally activated microvalve such that said timing control mechanism controls said thermally activated microvalve by controlling a length of time said thermally activated microvalve is actuated, whereby ink ejected from said nozzle is ejected in varying intensities at a constant rate, thereby maintaining a static printed pixel size.

32. The continuous color ink jet print head of claim 29, wherein said carrier fluid comprises a solvent.

33. The continuous color ink jet print head of claim 29, wherein said carrier fluid comprises water.

34. A continuous color ink jet print head for an electronic printing device, said continuous color ink jet print head comprising:

a nozzle;

a plurality of pressurized ink sources each having a fluid under pressure sufficient to eject a continuous flow of said fluid from said pressurized ink sources through said nozzle;

a plurality of channels connected in fluid communication to said nozzle, each of said channels being connected in fluid communication to at least one of said plurality of pressurized ink sources; and a thermally activated microvalve disposed within each of said channels such that flow of fluid from each of said plurality of pressurized ink sources through said nozzle is controlled by said microvalve, said microvalve having an open position, wherein fluid is permitted to be continuously ejected from at least one of said plurality of pressurized ink stances through said nozzle when said microvalve is in said open position and the fluid is a liquid.

35. A method in an electronic printing device for causing a continuous flow of ink drops to be expelled from a continuous color ink jet print head, said method comprising:

providing a nozzle in said continuous color ink jet print head so that ink drops can be ejected from said nozzle;

providing a plurality of channels within a print head surface of said continuous color ink jet print head, said plurality of channels being in communication with said nozzle to deliver ink under pressure sufficient to expel a drop; and selectively operating a thermally activated microvalve within at least one of said channels, each channel being connected through said microvalve to at least one pressurized ink source among a plurality of pressurized ink sources, said microvalve having an open position, wherein an ink drop is permitted to be continuously ejected through said nozzle when said microvalve is in said open position.

* * * * *